US006583693B2

(12) United States Patent
Paynter et al.

(10) Patent No.: US 6,583,693 B2
(45) Date of Patent: Jun. 24, 2003

(54) METHOD OF AND APPARATUS FOR CONNECTING WAVEGUIDES

(75) Inventors: Jeff Paynter, Richton Park, IL (US); Gary Frigo, Frankfort, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/924,645

(22) Filed: Aug. 7, 2001

(65) Prior Publication Data

US 2003/0030503 A1 Feb. 13, 2003

(51) Int. Cl.[7] ..... H01P 1/04
(52) U.S. Cl. ..... 333/254; 333/260
(58) Field of Search ..... 333/254, 260

(56) References Cited

U.S. PATENT DOCUMENTS

| | | | | | |
|---|---|---|---|---|---|
| 2,975,380 | A | * | 3/1961 | Scharfman | 333/125 |
| 3,374,450 | A | * | 3/1968 | Stewart | 333/254 |
| 3,784,939 | A | * | 1/1974 | Maeda et al. | 333/254 |
| 3,786,377 | A | | 1/1974 | Spinner | 333/254 |
| 3,818,383 | A | | 6/1974 | Willis | 333/21 R |
| 3,928,825 | A | | 12/1975 | Kaffenberger et al. | 333/34 |
| 3,942,141 | A | * | 3/1976 | Kaffenberger | 333/254 |
| 3,988,702 | A | | 10/1976 | Kaffenberger | 333/33 |
| 4,447,811 | A | | 5/1984 | Hamid | 343/783 |
| 4,642,585 | A | | 2/1987 | Saad | 333/21 R |
| 4,786,883 | A | * | 11/1988 | Spinner | 333/21 R |
| 4,932,673 | A | * | 6/1990 | Domnikov et al. | 277/608 |
| 5,148,593 | A | * | 9/1992 | Walter | 29/600 |
| 5,364,136 | A | * | 11/1994 | Forti et al. | 138/122 |
| 5,886,588 | A | | 3/1999 | Schneider | 333/21 R |
| 6,140,893 | A | * | 10/2000 | Sciarrino | 333/254 |

OTHER PUBLICATIONS

Article from website http://ewhdbks.mugu.navy.mil/WAVEGUID.htm on May 14, 2001 entitled "Microwave Waveguides and Coaxial Cables" (7 pages).

Article from website http://flux.aps.org/meetings/YR97/BAPSPAC97/abs/G570098.html on May 14, 2001 entitled "Simulation of Multipacting in RF cavities and waveguides" by A.V. Grudiev, D.G. Myakishev and V.P. Yakovlev (2 pages).

* cited by examiner

*Primary Examiner*—Michael Tokar
*Assistant Examiner*—Linh V Nguyen
(74) *Attorney, Agent, or Firm*—Jenkens & Gilchrist

(57) ABSTRACT

A waveguide connector for connecting an elliptical waveguide to a rectangular waveguide includes an elliptical-waveguide-receiving portion adapted to receive an end portion of an elliptical waveguide. The waveguide connector also includes a rectangular-waveguide-connecting portion adapted to connect to an end portion of a rectangular waveguide. After the end portion of the elliptical waveguide has been received in the elliptical-waveguide-receiving portion of the waveguide connector, the elliptical waveguide and the waveguide connector are soldered together. The rectangular-waveguide-connecting portion of the waveguide connector includes a flange with attachment points therein. The rectangular-waveguide-connecting portion of the waveguide connector is attached to a rectangular waveguide through the attachment points via screws, bolts, or the like. One embodiment of the waveguide connector includes unitary construction wherein a stepped transformer having transition sections is formed therewith.

34 Claims, 5 Drawing Sheets

METHOD OF AND APPARATUS FOR CONNECTING WAVEGUIDES

BACKGROUND

1. Field of the Invention

The present invention relates generally to waveguide connectors, and more particularly, but not by way of limitation, to a method of and apparatus for connecting waveguides of differing cross-sectional shapes one to the other.

2. Description of Related Art

The use of waveguides is commonplace for transmitting electromagnetic waves from one point to another. One of the more extensive commercial uses is the transmission of electromagnetic signals from transmitting or receiving equipment. This transmission may occur, for example, between an equipment shelter and an antennae, often mounted on a tall tower. In general, the waveguide consists of a hollow metallic tube of defined cross-section, uniform in extent in the direction of propagation. Within the hollow tube, the electric and magnetic fields are confined, and, since the tubes are normally filled with air, dielectric losses are minimal. Commercially available waveguides have a variety of cross-sectional shapes, including, for example, rectangular, circular and elliptical. Such waveguide shapes are, for example, disclosed in U.S. Pat. No. 3,822,411 to Merle and U.S. Pat. No. 4,047,133 to Merle.

Typically, waveguides must be coupled at some point. Both the design of the waveguide, as well as coupling systems for use therewith, are critical to the efficiency of the overall system and thus certain design parameters must be applied. For example, commonly-used rectangular waveguides may have an aspect ratio of approximately 0.5. This aspect ratio is well known to preclude the generation of field variations with height and their attendant unwanted modes. It is similarly well-known to securely mount a waveguide within a waveguide connector in order to prevent reflection losses and impendence mismatches. Reliable and secure mountings are not, however, always easy to accomplish. It is thus critical to provide the appropriate coupling mechanism and methods of assembly for use therewith when linking waveguides one to the other. This design concern is particularly relevant when joining waveguides of differing cross-sectional shape.

Waveguide connectors that are exemplary of prior designs are disclosed in U.S. Pat. No. 3,818,383 to Willis (the '383 Patent) and U.S. Pat. No. 3,784,939 to Maeda, et al. (the '939 Patent). The '383 Patent discloses an elliptical-to-rectangular waveguide transition that employs concave top and bottom walls of generally elliptical form and side walls of no concavity. Non-linear tapering of cross-sectional dimensions are employed to minimize reflections at the ends of the transition. The '939 Patent discloses a waveguide connector that is connected to a waveguide flared at its end by positioning a pressure member loosely encompassing the waveguide that is used to press the flared end of the waveguide against the connector so that paths of the waveguide and the connector are precisely aligned. Each of these connectors requires a flange and/or flaring of the waveguide(s) in order to achieve connection therebetween. As referenced above, the coupling of waveguides of differing shapes one to the other involves a myriad of design issues.

Another example of a connector for joining a rectangular waveguide to an elliptical waveguide is set forth and shown in U.S. Pat. No. 4,540,959 assigned to the assignee of the present invention (the '959 Patent), which patent is incorporated herein by reference. As set forth in the '959 Patent, an inhomogeneous waveguide connector may be designed to provide a low return loss over a wide bandwidth. The waveguide connector of the '959 Patent utilizes a stepped transformer formed within a connector passageway of a flanged connector for directly joining a rectangular waveguide and mounting flange assembly to an elliptical waveguide and mounting flange assembly.

The transformer, as therein described, includes multiple steps, all of which have inside dimensions small enough to cut off the first excitable higher order mode in a preselected frequency band. It may be seen that each step of the transformer includes an elongated transverse cross-section which is symmetrical about mutually perpendicular transverse axes which are common to those of the rectangular and elliptical waveguides, the dimensions of the elongated transverse cross-section increasing progressively from step to step in all four quadrants along the length of the transformer, in the direction of both of the transverse axes, so that both the cutoff frequency and the impedance of the transformer vary monotonically along the length of the transformer.

In addition to the functional efficiency, the waveguide connector of the '959 Patent is relatively easy to fabricate by machining so that it can be efficiently and economically manufactured with precise tolerances, and without costly fabricating techniques. Since the connector therein described incorporates a stepped transformer, the return loss decreases as the number of steps is increased so that the connector can be optimized for minimum length or minimum return loss, or any desired combination of the two, depending upon the requirements of any given practical application.

As seen in the waveguide connector designs discussed above, a significant functional and structural aspect of waveguide connectors is mechanical securement of the waveguides to the waveguide connector as well as the waveguide connectors to each other. The '959 Patent provides a good example of mating structural flanges. Such mating flanges have been commonplace for many years for the connection of waveguides one to the other. Typically, one of two mating flanges is secured to an end of a first waveguide in such a way that it will mate with the flange of a second waveguide also mounted directly to an end thereof or to the flange of a stepped transformer joining said waveguides as set forth in the '959 Patent. The mating flanges are then aligned and assembled one to the other, typically with threaded fasteners or the like.

Mating flanges are, by definition, constructed for coupling one to the other. The same is inherently untrue of the hollow tubes that form the waveguides themselves. While it is known how to securely mount and solder a rectangular waveguide to a waveguide mounting flange, the methods of and apparatus for reliable mounting of elliptical waveguides to waveguide connectors is not as well developed a technology. The coupling of elliptical waveguides to the requisite waveguide connector is therefore an area of concern from both engineering and quality control standpoints and also from a cost perspective. In that regard, flaring of portions of the elliptical waveguide, as described above, has been one approach for the mechanical coupling of the waveguide to the mounting flange. The flaring must typically be performed before a waveguide connector can be used to join the waveguide sections together. Such flaring is often performed in order to increase the mechanical strength of the interface between the waveguide connector and the waveguide. The flaring is also used to insure electrical continuity between the waveguide connector and the waveguide. It may be appreciated that the flaring of waveguides and related operations necessary in order to connect waveguides together in such a manner increases labor and materials costs.

It would be a distinct advantage, therefore, to provide a waveguide connector and method for connecting elliptical waveguides that could be used without the necessity of a flaring operation and/or related mechanical steps that are inherently less reliable than the soldered engagement of rectangular waveguides to their associated mounting flanges. It would thus be advantageous to provide a method of and apparatus for reliably connecting elliptical waveguides one to the other, as well as to rectangular waveguides and waveguides of other shapes, utilizing a connector that maximizes structural integrity without the prior art problems of mechanical interconnection and the associated cost inefficiencies associated therewith. It would further be a distinct advantage to provide an elliptical waveguide as described above with a stepped transformer formed therein.

BRIEF DESCRIPTION OF THE DRAWINGS

The foregoing and other advantages of the invention will become apparent upon reading the following detailed description, when taken in conjunction with the accompanied drawings, wherein.

DESCRIPTION OF ILLUSTRATIVE EMBODIMENTS

It has been discovered that an elliptical waveguide connector can be constructed for the receipt and secured mounting of an elliptical waveguide therein without the need for flaring. Flexible, elliptical waveguides are inherently more difficult to effectively and reliably mount within waveguide connectors. However, it has been found that a secure elliptical waveguide connector mounting can be reliably effected with the use of solder while reducing the possibility of reflection losses and/or impendence mismatches. The elliptical waveguide connector, according to one embodiment of the present invention, can also be of a one-piece, or unitary, construction that is less expensive to produce and more reliable in operation than prior art elliptical waveguide connectors that require flaring of, or other attachments techniques for, the elliptical waveguide. The waveguide connector may also be constructed with a stepped transformer integral therewith, as will be set forth in more detail below.

Figure 1:
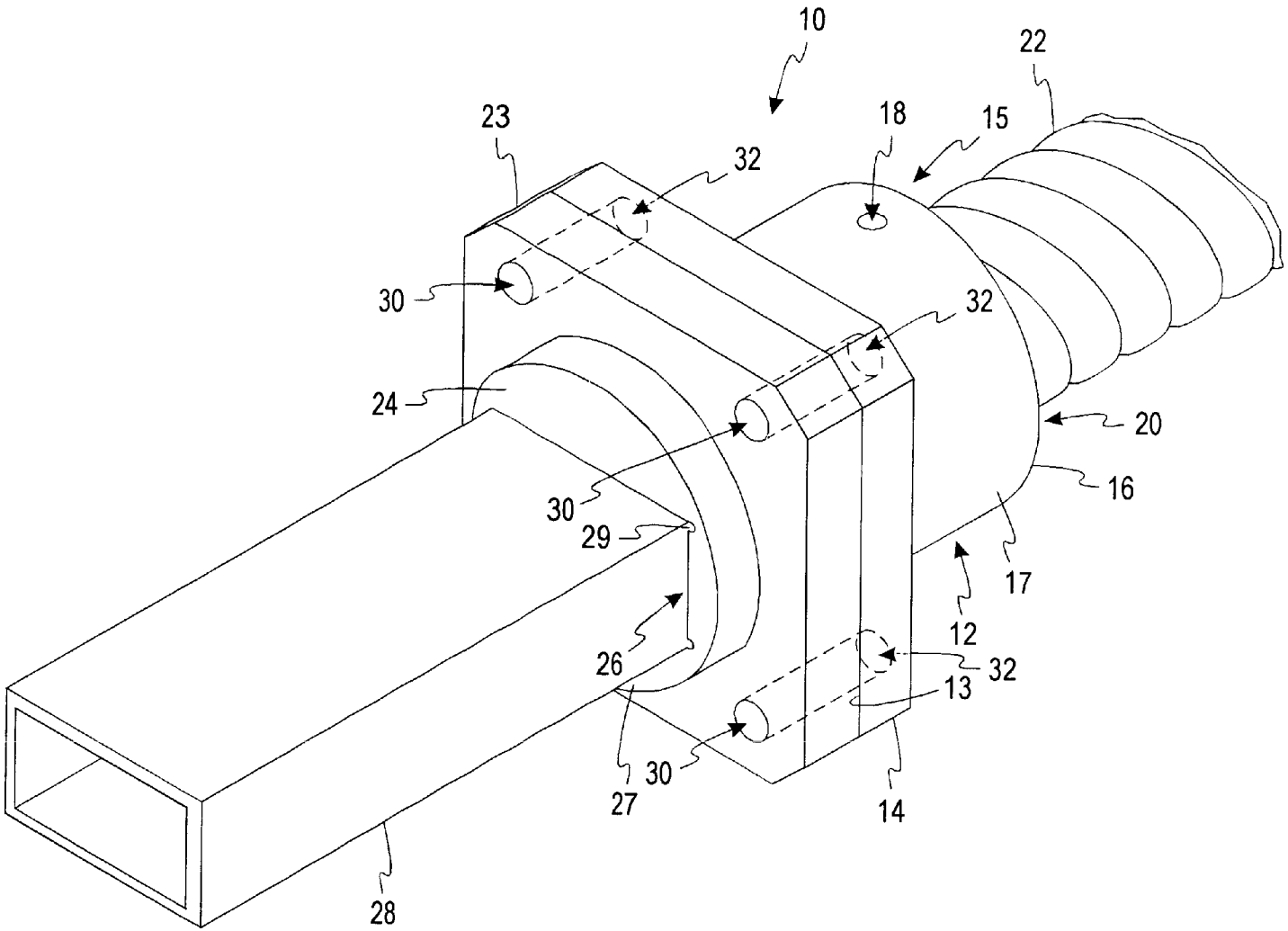
FIG. 1 is a perspective view of one embodiment of a waveguide connector constructed in accordance with the principles of the present invention, and illustrating the connection of an elliptical waveguide to a rectangular waveguide in axial alignment therewith.

The present invention will now be described in connection with the embodiments shown in the drawings. Referring first to FIG. 1, there is shown an elliptical waveguide connector 10 having received therein, in secured structural mounting therewith, an elliptical waveguide 22. The illustrated elliptical waveguide connector 10 includes a waveguide connector housing 12 having at a first end 13 a generally rectangular mounting flange 14. The mounting flange 14 is adapted for mating engagement with, and securement to, a second waveguide mounting flange, as described in more detail below. The generally rectangular mounting flange 14 is constructed with a generally cylindrical boss 16 having a cylindrical outer surface 17 extending rearwardly therefrom to define a second end 15. The boss 16 is constructed of sufficient length to accommodate a generally elliptical waveguide receiving portion and a stepped transformer therein, neither of which are seen in this view, but which are described in more detail below. Also shown is a top solder port 18 formed through the cylindrical outer surface 17 and within the generally cylindrical boss 16 of the waveguide connector housing 12 to afford access to the elliptical waveguide 22 received within the elliptical waveguide receiving portion constructed therein, for securement of said elliptical waveguide 22 thereto.

Still referring to FIG. 1, the elliptical waveguide connector 10 of this particular embodiment, is shown connected to a rectangular waveguide mounting flange 23. The rectangular waveguide mounting flange 23 is constructed with a generally cylindrical boss 24 extending therefrom, the boss 24 having a generally rectangular waveguide receiving portion 26 formed therein. A generally rectangular waveguide 28 is shown mounted thereto. The generally rectangular waveguide 28 is received within the generally rectangular waveguide receiving portion 26 formed in the generally cylindrical boss 24 and secured therein by solder. A plurality of solder ports 29 are shown to be formed within a face 27 of the generally cylindrical boss 24. The solder ports 29 in the face 27 permit the introduction of solder around the rectangular waveguide 28 as heat is applied thereto. In this way, the rectangular waveguide 28 is securely mounted within the rectangular waveguide receiving portion 26 of the generally cylindrical boss 24. The rectangular waveguide 28 is securely positioned in abutting relationship against mating surfaces presented within the rectangular waveguide receiving portion 26, prior to soldering, for the necessary structural securement thereof and for the efficient operation therewith. With proper alignment of the waveguide 28 against the above-referenced mating surface, it is feasible to prevent molten solder from dripping into the waveguide or into the waveguide-receiving portion 26. Such an assembly error could have the deleterious effect of negative performance due to increased reflection losses and/or impedance mismatches.

Still referring to FIG. 1, the use of waveguide connecting flanges for the coupling of waveguide connectors is well established. The fabrication of the generally cylindrical boss 24 as a portion of such connecting flanges may be preferred in certain applications due to the fact that it is easier to machine a cylindrical region, with the use of a lathe or the like. It is also known to utilize a series of appropriately disposed apertures 30 formed in corners of the generally rectangular flange 23 for receiving threaded fasteners (not shown in this view) therein. A plurality of apertures 32 are thus formed in the mounting flange 14 of the waveguide connector housing 12 of the present invention, for mating coupling with the apertures 30, as discussed below.

Figure 2:
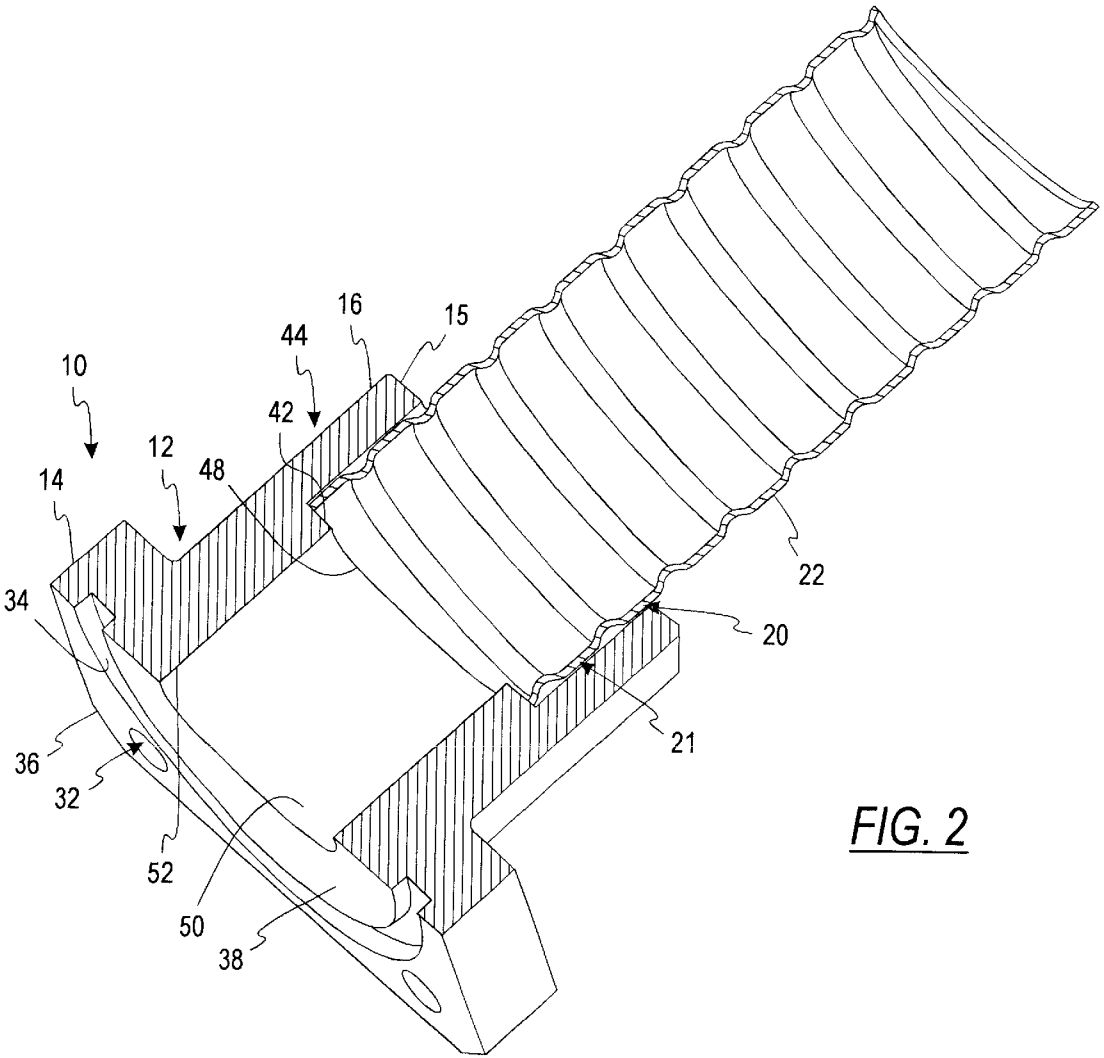
FIG. 2 is an enlarged, cross-sectional perspective view of the elliptical waveguide connector and elliptical waveguide of FIG. 1.

Referring now to FIG. 2, there is shown an enlarged, perspective view of the connector 10 and waveguide 22 of FIG. 1, illustrating various aspects of the construction thereof. As shown in this particular view, the plurality of apertures 32 are formed within the mounting flange 14 in the corners thereof and in registry with the apertures 30 of the flange 23 as shown in FIG. 1. Likewise, a groove 34 is formed in a face 36 of the waveguide connector housing 12 to therein provide means for mounting an o-ring (not shown) and further defining a mating surface 38 for abutting engagement with a respective mating surface on the mounting flange 23 shown in FIG. 1. It should be noted that the O-ring mounting aspect is optional and is shown for purposes of illustration. Also shown in this particular view is the elliptical waveguide receiving portion 20, which comprises an elliptical cavity 21 constructed in the end 15 of the waveguide connector housing 12 and terminating in a shoulder 42 formed therein. The cavity 21 of the elliptical waveguide receiving portion 20 thus forms a sleeve 44 of substantially mating configuration with the elliptical waveguide 22 that is received therein.

The sleeve 44 in this particular embodiment is sized to permit a slip fit inter-engagement between the elliptical waveguide 22 and the waveguide connector 10 having the housing 12 with an end 48 of the waveguide 22 abutting firmly against the shoulder 42 of the elliptical waveguide receiving portion 20. This abutting relationship is required for the use of molten solder, as referenced above. Due to the length of the cavity 21 defining the sleeve 44 between the shoulder 42 and the end 15 of the waveguide connector housing 12, the elliptical waveguide 22 may be securely mounted thereto. In the present embodiment, solder is then available for use in securing the elliptical waveguide 22 within the sleeve 44. This secured mounting is preferably effected without the need for flaring of the elliptical waveguide 22. However, if it is desirable to flare the end 48 of the waveguide 22 in order to reduce reflection losses between the waveguide 22 and the waveguide connector 10, the end 48 can be flared and the sleeve 44 dimensioned accordingly to accommodate the flaring of the end 48.

Still referring to FIG. 2, an axial passageway 50 is formed within the housing 12. The passageway 50 is formed of sufficient length to provide an integrally formed inhomogeneous waveguide connector and transition for joining a rectangular waveguide to an elliptical waveguide as set forth above. The construction of the passageway 50, with side walls 52 and 53, including a stepped transformer formed therein, will be described in more detail below.

Figure 3:
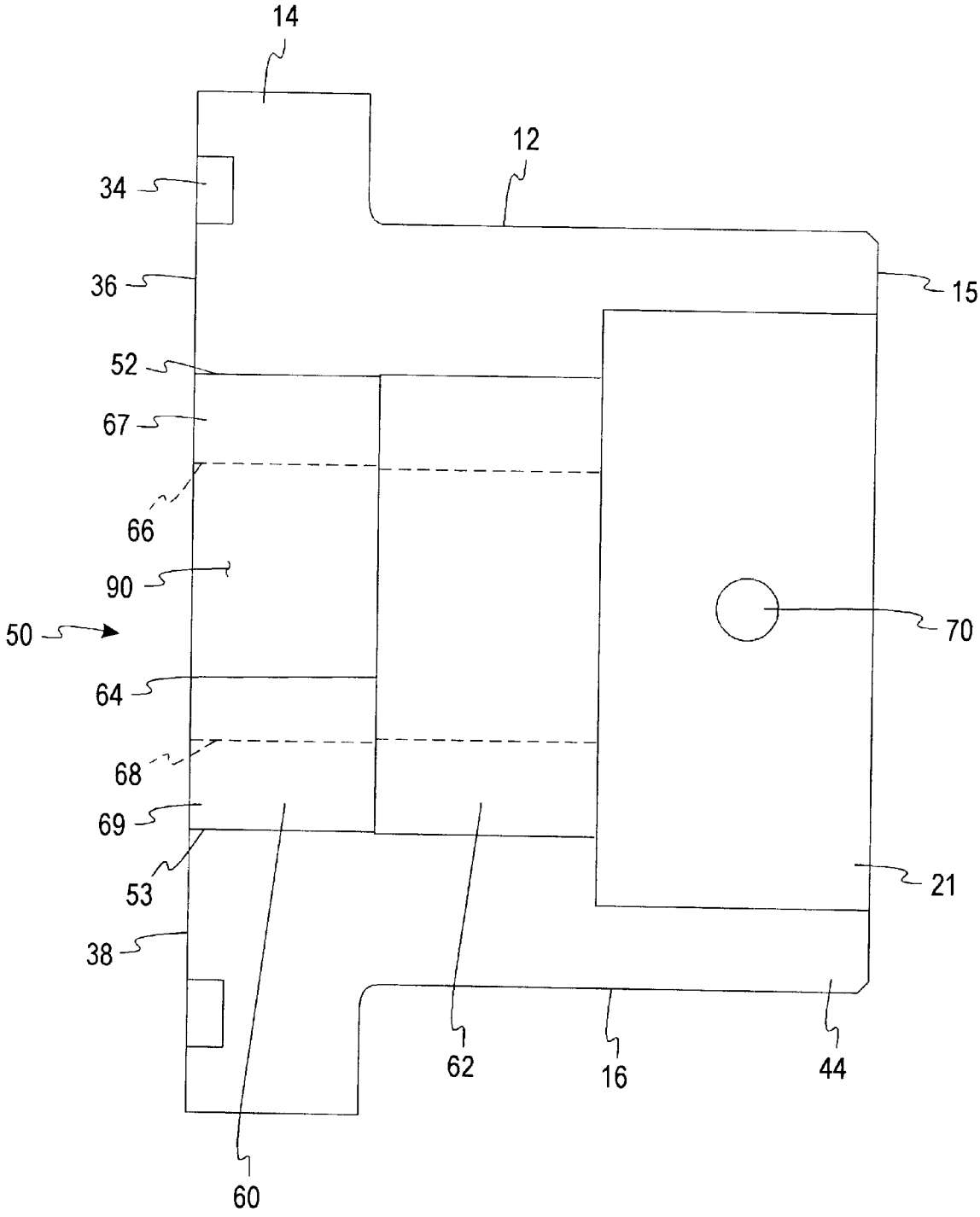
FIG. 3 is an enlarged, side-elevational, cross-sectional view of the elliptical waveguide connector of FIG. 1 illustrating transition sections of a stepped transformer formed therein.

Referring now to FIG. 3, there is shown an enlarged top plan, cross-sectional view of the waveguide connector housing 12 of FIG. 1, illustrating certain aspects of the construction thereof. The waveguide connector housing 12 of this particular embodiment is of unitary construction with the mounting flange 14 having the groove 34 formed therein around the face 38. The passageway 50 extends from the face 36 to the end 15, where a lower solder port 70 is formed in the elliptical cavity 21. The passageway 50 is also preferably formed in this embodiment by machining or the like, with the side walls 52 and 53 defining transition sections 60 and 62 axially aligned one with the other. The transition sections 60 and 62 shown herein are milled in the waveguide connector housing 12 and are separated by a shoulder portion 64. The transition sections 60 and 62 are specifically sized to form a waveguide stepped transformer for joining a rectangular waveguide to an elliptical waveguide. The method of construction of the transition sections 60 and 62 of this particular embodiment produces transition lines 66 and 68, which may be seen along the portion of passageway 50 forming the transition section 60. The transition lines 66 and 68 are formed when curved machined corners 67 and 69, respectively, intersect with planar sections of passageway 50 forming planar bottom surface 90.

Figure 4:
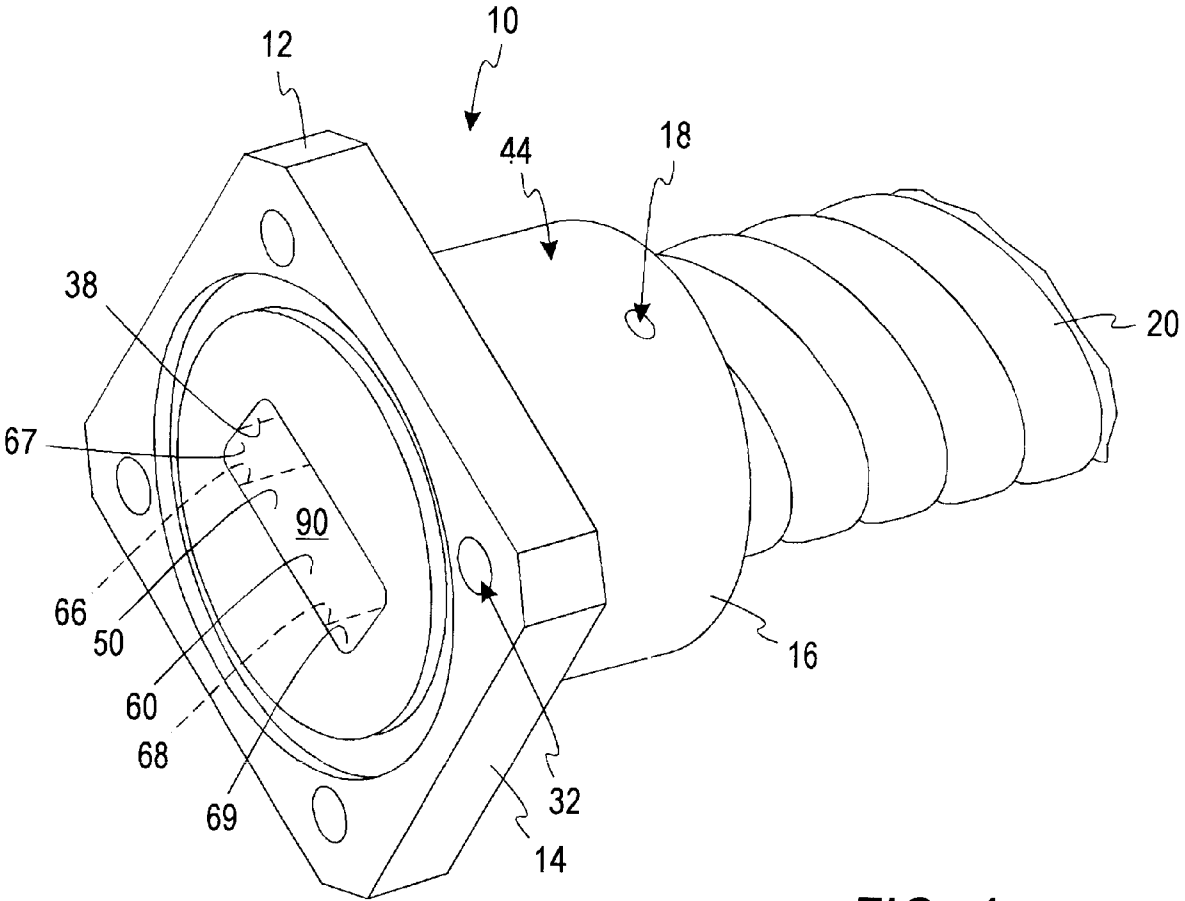
FIG. 4 is a perspective view of the elliptical waveguide connector of FIG. 1.

Referring now to FIG. 4, there is shown an isolated perspective view of the waveguide connector 10 and the elliptical waveguide 22 mounted therein. The waveguide connector housing 12 of this particular embodiment may be seen to have the mounting flange 14 formed with the four apertures 32 positioned in the four corners thereof and adapted to be in registry with the apertures 30 of the flange 23 of FIG. 1. The passageway 50 providing the integrally formed stepped transformer is clearly shown, and the first transition section 60 of the transformer may be seen in conjunction with the transition lines 66 and 68 discussed above. As described above, the transition lines 66 and 68 define the changing shape of the passageway 50 in the transition section 60 between the planar bottom surface 90 and lower curved wall regions 67 and 69, respectively, of the passageway 50, the same defining the first transition section 60. Likewise, the top solder port 18 is shown in the generally cylindrical boss 16. The top solder port 18, in conjunction with lower solder port 70 shown in FIG. 3, further facilitates the securement of the elliptical waveguide 22 within the sleeve 44 defined within the boss 16 by facilitating the application of molten solder within the sleeve 44.

Still referring to FIG. 4, it may be seen that the construction of the elliptical waveguide connector 10 includes the provision of the sufficiently long, generally cylindrical boss 16 to afford sufficient length for both the stepped transformer and the secured mounting of the waveguide 22. Since the use of molten solder has been a proven mounting technique for rectangular waveguides, the ability to utilize such molten material with an elliptical waveguide is a marked advance over prior designs. By securely abutting the elliptical waveguide 22 in the sleeve 44 as described above, a reliable mounting configuration is provided in an assembly that can be easily fabricated at a relatively low cost. The connection between the elliptical waveguide 22 and the sleeve 44 as shown herein further accommodates the bending moments that can be created between a flexible waveguide and the connector secured thereto.

In use, the connector 10 of FIGS. 1–4 may be easily and reliably secured to the elliptical waveguide 22 by insertion of the end 15 of the waveguide 22 into the sleeve 44. The end 15 of the waveguide 22 is positioned in abutting relationship with the shoulder 42 and molten solder is applied thereby via the solder ports 18 and 70 extending transversely through the waveguide connector housing 12. By the utilization of solder introduced through the solder ports 18 and 70, along with the introduction of heat, the solder (not shown) is allowed to flow and/or wick around the elliptical waveguide 22 to therein form a bond between the elliptical waveguide 22 and the sleeve 44 which, upon cooling, secures the engagement of the elliptical waveguide 22 to the elliptical waveguide connector 10. The design of the connector 10 thus permits solder to be used for elliptical waveguide mounting without the potentially deleterious effects thereof referenced above.

Figure 5:
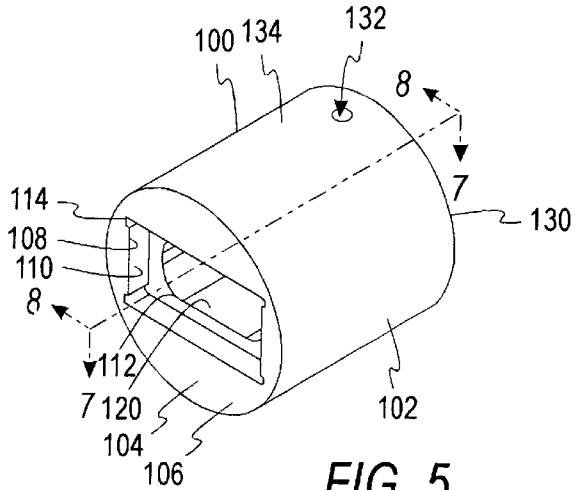
FIG. 5 is a perspective view of an alternative embodiment of a waveguide connector constructed in accordance with the principles of the present invention and providing for the coupling of rectangular and elliptical waveguides one to the other without the utilization of mounting flanges therewith.

Referring now to FIG. 5, there is shown an alternative embodiment of the present invention, wherein a single waveguide connector with an integrally formed stepped transformer is provided for mounting waveguides, including a generally rectangular waveguide, to a generally elliptical waveguide without the need for conventional waveguide flanges or the like. The waveguide connector 100 of FIG. 5 includes a generally cylindrical housing 102 having a first end 104 formed with a generally rectangular waveguide receiving portion 106 formed therein. The generally rectangular waveguide receiving portion 106 is formed of a generally rectangular orifice 108 having side walls 110 terminating in a shoulder 112. A plurality of solder ports 114 are formed in opposite corners of the generally rectangular orifice 108 and a passageway 120 extends therefrom. The passageway 120 is constructed to form a stepped transformer of the type defined above as an integral portion thereof and as further illustrated below.

Still referring to FIG. 5, a second, opposite end 130 of the housing 102 is constructed for receipt of a generally elliptical waveguide (not shown) as described above. In that respect, a first solder port 132 is shown constructed within a top surface 134 of the housing 102. More specific aspects of the utilization of solder ports, as well as the construction of the housing 102, will be described in more detail below.

Still referring to FIG. 5, it may be seen that the housing 102 will permit the connection of a generally rectangular waveguide to a generally elliptical waveguide without the utilization of waveguide flanges and/or the necessity of threaded fasteners therewith. The connection of the generally rectangular waveguide to the generally elliptical waveguide may be effected solely by the utilization of solder and the application of heat to firmly secure the respective waveguides within the connector 100, which may be of unitary construction. Other functional aspects of the connector 100, for example, the design and construction of the passageway 120 as an inhomogeneous waveguide connector, are essentially the same as that described above relative to the utilization of the connector 10 shown in FIG. 1.

Figure 6:
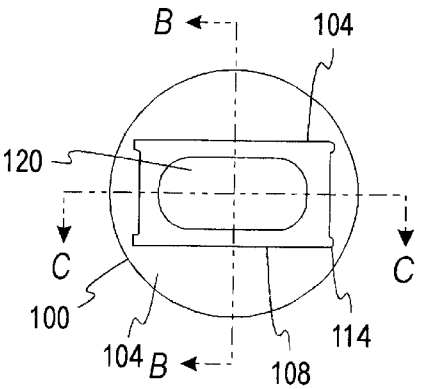
FIG. 6 is an end-elevational view of the waveguide connector of FIG. 5.

Referring now to FIG. 6, there is shown an end elevational view of the waveguide connector 100 of FIG. 5. The face 104 illustrated with the generally rectangular waveguide receiving portion 106 comprises the generally rectangular orifice 108 defining the passageway 120 formed through housing 102. The apertures 114 may be seen to be integral portions of the opposite corners of the generally rectangular orifice 108.

Figure 7:
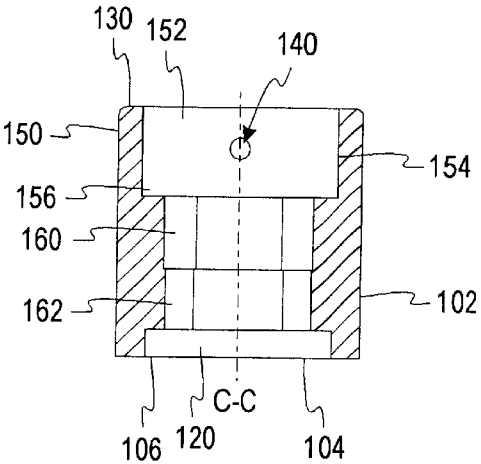
FIG. 7 is a top plan, cross-sectional view of the waveguide connector of FIG. 5 taken along lines 7—7 thereof.

Referring now to FIG. 7, there is shown a top plan cross-sectional view of the housing 102 of FIG. 5 illustrating, in more detail, the passageway 120 formed therethrough and a lower solder port 140 formed therein. The solder port 140 is disposed in an elliptical waveguide receiving sleeve 150 extending inwardly from the end 130 of the housing 102. The sleeve 150 is constructed in the same manner as the sleeve 44 of the connector 10 described above. Sleeve 150 thus includes a generally elliptical waveguide receiving portion 152 having elliptical sidewalls 154 adapted for slip fit receipt and engagement of a generally elliptical waveguide therein.

A shoulder 156 defines the innermost portion of the sleeve 150. The shoulder 156 is adapted for abutting engagement of a generally elliptical waveguide thereagainst in the manner described above relative to the shoulder 42 of the sleeve 44 of the connector 10. First and second transition sections, 160 and 162, respectively, are also formed within the passageway 120 connecting the sleeve 150 to the generally rectangular orifice 108 forming the generally rectangular waveguide receiving portion 106 of the end 104 of the housing 102.

Figure 8:
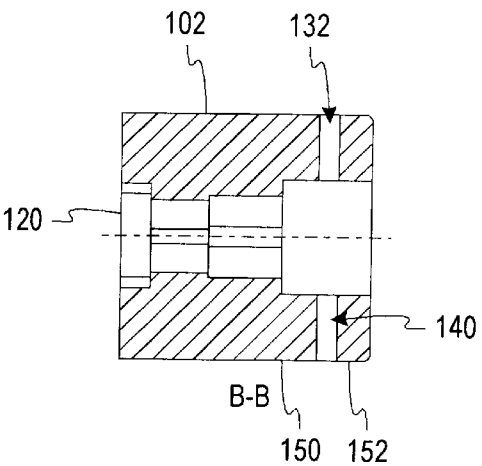
FIG. 8 is a side-elevational, cross-sectional view of the waveguide connector of FIG. 5 taken along lines 8—8 thereof.

Referring now to FIG. 8, there is shown a side elevational cross-sectional view of the housing 102 of FIG. 5 illustrating the passageway 120 formed therethrough and other aspects of the construction thereof The top solder port 132 is shown oppositely disposed from the lower solder port 140 formed within the sleeve 150 of the housing 102. The solder ports 132 and 140 permit the access of solder to the region of the sleeve 150 for securement of an elliptical waveguide therein.

In use, the connector 100 of FIGS. 5–8 may easily and reliably secured to the elliptical waveguide 22 by the insertion of an end portion of the waveguide 22 into the sleeve 150. The end of the waveguide 22 is positioned in abutting relationship with the shoulder 156 and molten solder is applied thereby via the solder ports 132 and 140 extending transversely through the cylindrical housing 102. By the utilization of solder introduced through the solder ports 132 and 140 along with the introduction of heat, the solder (not shown) is allowed to flow and/or wick around the elliptical waveguide 22 (shown in FIGS. 1–4) to therein form a bond between the elliptical waveguide 22 and the sleeve 150, which, upon cooling, secures the engagement of the elliptical waveguide 22 to the waveguide connector 100. Such mounting and securement may be performed "in the field" with essentially the same ease as the use of threaded fasteners, but with greater reliability. Likewise the insertion and secured mounting of a second, opposite waveguide may be effected with equal simplicity as described above. The second, opposite waveguide may be of any conventional shape, including, but not limited to, rectangular waveguides as shown herein.

Although preferred embodiment(s) of the present invention have been illustrated in the accompanying Drawings and described in the foregoing Description, it will be understood that the present invention is not limited to the embodiment(s) disclosed, but is capable of numerous rearrangements, modifications, and substitutions without departing from the spirit and scope of the present invention as set forth and defined by the following claims.

What is claimed is:

1. A waveguide connector for coupling an elliptical waveguide to a rectangular waveguide and mounting flange assembly, said waveguide connector comprising:

a one-piece unitary housing having a passageway formed therethrough, opposite ends thereof being adapted to engage the elliptical waveguide and the rectangular waveguide and mounting flange assembly;

said passage having an axially inwardly extending elliptical waveguide receiving portion, an inner surface of the elliptical waveguide receiving portion terminating in a shoulder for abutting an end portion of the elliptical waveguide thereagainst; and said housing having only a single flange, said flange being a rectangular-waveguide mounting flange adapted to connect to the rectangular waveguide and mounting flange assembly.

2. The waveguide connector of claim 1, wherein said housing includes at least one solder port and the elliptical waveguide is non-flared and soldered to the elliptical waveguide receiving portion of said housing.

3. The waveguide connector of claim 2, wherein the rectangular waveguide and mounting flange assembly is connected to the rectangular waveguide mounting flange of said housing via a plurality of threaded fasteners.

4. The waveguide connector of claim 1, further comprising a stepped transformer, wherein:

said stepped transformer comprises a plurality of transition sections having sufficiently-small dimensions to cut off a first excitable higher order mode in a predefined frequency band;

at least one transition section of said stepped transformer comprises an elongated transverse cross section that is symmetrical about two mutually-perpendicular transverse axes common to corresponding axes of the rectangular waveguide and of the elliptical waveguide;

the elongated transverse cross section comprises a dimension that increases progressively from step to step along a length of the transformer; and each step increases in the direction of both of the mutually-perpendicular transverse axes such that both a cut-off frequency and an impedance of the stepped transformer vary monotonically along the length of the stepped transformer.

5. The waveguide connector of claim 1, further comprising a stepped transformer, wherein a transverse cross section of said stepped transformer has a generally rectangular shape, a width and a height of the generally rectangular shape increasing progressively from step to step along a length of the stepped transformer.

6. The waveguide connector of claim 5, wherein the generally rectangular shape of the transverse cross section comprises arcuate corners.

7. The waveguide connector of claim 1, further comprising a stepped transformer, wherein a cutoff frequency of said stepped transformer progressively increases, at each step, from a waveguide having a lower cutoff frequency toward a waveguide having a higher cutoff frequency.

8. The waveguide connector of claim 1, further comprising a stepped transformer, wherein an impedance of said stepped transformer progressively increases from a waveguide having a lower impedance toward a waveguide having a higher impedance.

9. The waveguide connector of claim 1, wherein said elliptical waveguide receiving portion is constructed with a pair of oppositely disposed solder ports adapted for permitting the introduction of solder and the securement of a non-flared waveguide therein.

10. A method of connecting an elliptical waveguide to a rectangular waveguide and mounting flange assembly comprising:

providing a waveguide connector having a one-piece, unitary housing comprising an elliptical waveguide receiving portion and only a single flange;

inserting an end portion of the elliptical waveguide axially into a receiving sleeve formed in the elliptical waveguide receiving portion;

securing the end portion of the elliptical waveguide to the elliptical waveguide receiving portion; and fastening the flange to the rectangular waveguide and mounting flange assembly.

11. The method of claim 10, wherein said steps are performed in the order listed.

12. The method of claim 10, further including the step of forming at least one solder port in the elliptical waveguide receiving portion of the housing.

13. The method of claim 12, wherein said step of securing the end portion of the elliptical waveguide comprises the step of soldering.

14. The method of claim 10, wherein said step of securing comprises soldering the end portion of the elliptical waveguide to the elliptical waveguide receiving portion via at least one solder port in the elliptical waveguide receiving portion.

15. The method of claim 10, wherein the end of the elliptical waveguide is non-flared.

16. The method of claim 10, wherein said step of fastening comprises connecting the flange to the rectangular waveguide and mounting flange assembly via a plurality of threaded fasteners.

17. A method of connecting an elliptical waveguide to a rectangular waveguide and mounting flange assembly comprising:

providing a one-piece, unitary housing having an elliptical waveguide receiving portion in a first end thereof and only a single flange in a second end thereof, the housing further including a passageway passing through the elliptical waveguide receiving portion and the single flange;

inserting an end of the elliptical waveguide axially into the elliptical waveguide receiving portion;

securing the end of the elliptical waveguide to the elliptical waveguide receiving portion; and fastening the single flange to the rectangular waveguide and mounting flange assembly.

18. The method of claim 17, wherein said steps are performed in the order listed.

19. The method of claim 17, further including the step of forming at least one solder port in the receiving sleeve of the elliptical waveguide receiving portion of the housing.

20. The method of claim 19, wherein said step of securing comprises soldering.

21. The method of claim 17, wherein the end of each of the elliptical waveguides is non-flared.

22. The method of claim 17, wherein the end of at least one of the elliptical waveguides is non-flared.

23. A waveguide connector adapted to be coupled to an elliptical waveguide, the waveguide connector comprising:

a one-piece, unitary housing having a passageway formed therethrough, an end of said passageway being adapted to receive and surroundingly engage an axial end part of the elliptical waveguide thereby defining an elliptical waveguide receiving portion;

an inner surface of the elliptical waveguide receiving portion terminating in a shoulder for abutting an outer end surface of said elliptical waveguide thereagainst;

means for securing the end surface of the elliptical waveguide in abutment against said shoulder; and a single flange for connecting said waveguide connector to a rectangular waveguide and mounting flange assembly.

24. The waveguide connector of claim 23, wherein said housing includes at least one solder port.

25. The waveguide connector of claim 23, wherein the elliptical waveguide is non-flared and said means for securing comprises solder.

26. The waveguide connector of claim 23, wherein, said means for securing comprises a pair of oppositely disposed solder ports in said housing, said solder ports terminating in said elliptical waveguide receiving portion and being adapted to receive solder therethrough for the securement of the waveguide therein.

27. The waveguide connector of claim 23, wherein said means for securing comprises a pair of oppositely disposed solder ports in said housing, said solder ports terminating in said elliptical waveguide receiving portion and being adapted to receive solder therethrough for the securement of the waveguide therein.

28. The waveguide connector of claim 27, wherein said solder ports are adapted to permit solder to contact the inner surface of said elliptical waveguide receiving portion and to contact an outer surface of the end portion of the elliptical waveguide without permitting the solder to extend within said housing past said shoulder.

29. The waveguide connector of claim 23, further comprising a stepped transformer, wherein:

said stepped transformer comprises a plurality of transition sections having sufficiently-small dimensions to cut off a first excitable higher order mode in a predefined frequency band;

at least one transition section of said stepped transformer comprises an elongated transverse cross section that is symmetrical about two mutually-perpendicular transverse axes common to corresponding axes of a rectangular waveguide of the rectangular waveguide and mounting flange assembly and of the elliptical waveguide; and mutually-perpendicular transverse axial dimensions of said transition sections increase such that both a cut-off frequency and an impedance of the stepped transformer vary monotonically along a length of the stepped transformer.

30. The waveguide connector of claim 29, wherein the generally rectangular shape of said transverse cross section includes arcuate corners.

31. The waveguide connector of claim 23, further comprising a stepped transformer wherein a transverse cross section of said stepped transformer has a generally rectangular shape, a width and a height of the generally rectangular shape increasing progressively from step to step along a length of said stepped transformer.

32. The waveguide connector of claim 23, further comprising a stepped transformer wherein a cutoff frequency of said stepped transformer progressively increases, at each step, from a waveguide having a lower cutoff frequency toward a waveguide having a higher cutoff frequency.

33. The waveguide connector of claim 23, further comprising a stepped transformer, wherein an impedance of said stepped transformer progressively increases from a waveguide having a lower impedance toward a waveguide having a higher impedance.

34. The waveguide connector of claim 23, wherein the waveguide connector is made of unitary construction.

* * * * *